US008267442B2

(12) United States Patent
Tien et al.

(10) Patent No.: US 8,267,442 B2
(45) Date of Patent: Sep. 18, 2012

(54) OUTER OPERATIONAL DEVICE FOR PANIC EXIT DOOR LOCK

(75) Inventors: Hung-Jen Tien, Tainan (TW); Chen-Wei Huang, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 871 days.

(21) Appl. No.: 12/331,575

(22) Filed: Dec. 10, 2008

(65) Prior Publication Data

US 2010/0140961 A1 Jun. 10, 2010

(51) Int. Cl.
*E05B 65/10* (2006.01)

(52) U.S. Cl. ..... 292/93; 292/36; 292/138; 292/165

(58) Field of Classification Search ..... 292/36, 292/138–139, 1, 32, 137, 165, 169, 170, 292/169.12–169.17; 70/107–111, 141, 462
See application file for complete search history.

(56) References Cited

U.S. PATENT DOCUMENTS

| | | | | | |
|---|---|---|---|---|---|
| 3,334,500 | A | * | 8/1967 | Bejarano | 70/92 |
| 3,808,849 | A | * | 5/1974 | Alexander | 70/149 |
| 3,999,789 | A | * | 12/1976 | Maurits et al. | 292/34 |
| 4,363,227 | A | * | 12/1982 | Lo | 70/144 |
| 4,427,223 | A | * | 1/1984 | Godec et al. | 292/92 |
| 4,741,563 | A | | 5/1988 | Cohrs | 292/21 |
| 4,838,053 | A | * | 6/1989 | Shen | 70/92 |
| 4,961,330 | A | | 10/1990 | Evans | 292/21 |
| 4,974,890 | A | | 12/1990 | Cohrs | 292/363.3 |
| 4,982,986 | A | * | 1/1991 | Gressett et al. | 292/336.3 |
| 5,077,992 | A | * | 1/1992 | Su | 70/107 |
| 5,373,716 | A | * | 12/1994 | MacNeil et al. | 70/109 |
| 5,492,380 | A | * | 2/1996 | Smallegan et al. | 292/336.3 |
| 5,520,427 | A | | 5/1996 | Mader | 292/336.3 |
| 5,564,760 | A | | 10/1996 | Mader | 292/182 |
| 5,566,994 | A | | 10/1996 | Mader | 292/336.3 |
| 5,570,916 | A | | 11/1996 | Mader | 292/336.3 |
| 5,655,393 | A | * | 8/1997 | Kuo et al. | 70/107 |
| 5,658,026 | A | * | 8/1997 | Nigro et al. | 292/336.3 |
| 5,713,612 | A | * | 2/1998 | Kajuch | 292/36 |
| 6,443,506 | B1 | * | 9/2002 | Su | 292/244 |
| 6,454,322 | B1 | * | 9/2002 | Su | 292/244 |
| 6,581,423 | B2 | * | 6/2003 | Lin | 70/107 |
| 6,615,629 | B2 | * | 9/2003 | Bates et al. | 70/434 |
| 6,725,693 | B2 | * | 4/2004 | Yu et al. | 70/107 |
| 6,758,070 | B2 | * | 7/2004 | Yu et al. | 70/107 |
| 7,181,940 | B2 | * | 2/2007 | Lin | 70/472 |
| 7,249,477 | B2 | * | 7/2007 | Toloday et al. | 70/279.1 |
| 7,287,787 | B1 | * | 10/2007 | Tannone | 292/336.3 |
| 7,364,212 | B1 | | 4/2008 | Fan | 292/336.3 |
| 7,818,984 | B2 | * | 10/2010 | Hwang | 70/107 |
| 7,926,315 | B2 | * | 4/2011 | Poletti | 70/107 |
| 2007/0114801 | A1 | * | 5/2007 | Lin | 292/336.3 |
| 2010/0154490 | A1 | * | 6/2010 | Hagemeyer et al. | 70/107 |

* cited by examiner

*Primary Examiner* — Thomas A Beach
*Assistant Examiner* — Mark Williams
(74) *Attorney, Agent, or Firm* — Alan Kamrath; Kamrath IP Lawfirm, PA

(57) ABSTRACT

An outer operational device includes a cover mounted to a side of a door. An actuating member is mounted in the cover and includes an end engaged with a handle to rotate therewith. A driving member is pivotably received in the cover and includes a wing. A link includes an upper end pivotably coupled with the wing and a lower end pivotably coupled with an end of the actuating member. A driving rod is coupled with the driving member and operably connected to a latch of a lock mounted in the door, so that rotation of the handle causes retraction of the latch.

8 Claims, 15 Drawing Sheets

OUTER OPERATIONAL DEVICE FOR PANIC EXIT DOOR LOCK

BACKGROUND OF THE INVENTION

The present invention relates to an outer operational device for a panic exit door lock and, more particularly, to an outer operational device for a panic exit door lock that includes a handle for unlocking purposes.

Panic exit door locks of the type having a latch extending through a vertical, lateral side of a door generally include inner and outer operational devices that can be operated to unlock the door. However, troublesome installation is required when mounting the door locks to a differently handed door. To allow slight adjustment of positions of the inner and outer operational devices during on-site installation, the door generally includes a plurality of through-holes through which mounting posts are extended. The through-holes have diameters larger than those of the mounting posts such that the latch may not be completely retracted for unlocking purposes. In this case, detachment of the whole door lock is required, leading to inconvenient installation.

Thus, a need exists for an outer operational device for a panic exit door lock that can be mounted to differently handed doors with less effort while allowing reliable on-site installation without adjustment.

BRIEF SUMMARY OF THE INVENTION

The present invention solves this need and other problems in the field of panic exit door locks by providing, in a preferred form, an outer operational device including a cover adapted to be mounted to a side of a door. A handle includes a shank having an engaging portion with non-circular cross sections. The shank is rotatably received in the cover. An actuating member is mounted in a space in the cover and includes a first end and a non-circular connecting hole engaged with the engaging portion to rotate therewith. The actuating member further includes a first groove in an inner periphery of the non-circular connecting hole. A follower includes a non-circular hole engaged with the engaging portion of the handle to allow joint rotation of the follower and the handle. The follower includes a first tooth engaged in the first groove to allow joint rotation of the handle, the actuating member, and the follower. A first link includes an upper end and a lower end. The lower end of the first link is pivotably coupled with the first end of the actuating member. A driving member includes a pivotal portion pivotably received in the space of the cover. A first wing extends from the pivotal portion and is pivotably coupled to the upper end of the first link. A driving rod is securely coupled with the pivotal portion to rotate therewith. The driving rod is adapted to be extended into a lock mounted in the door and operably coupled to a latch of the lock, such that rotation of the handle causes rotation of the follower and the actuating member to move the link and the driving rod, moving the latch between an extended, locking position and a retracted, unlocking position.

In the most preferred form, the actuating member includes a second groove in the inner periphery of the non-circular connecting hole. The actuating member further includes a second end. The connecting hole is intermediate the first and second ends of the actuating member. The follower includes a second tooth engaged in the second groove. The driving member includes a second wing diametrically opposed to the first wing. A second link includes an upper end pivotably coupled with the second wing and a lower end pivotably coupled with the second end of the actuating member.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
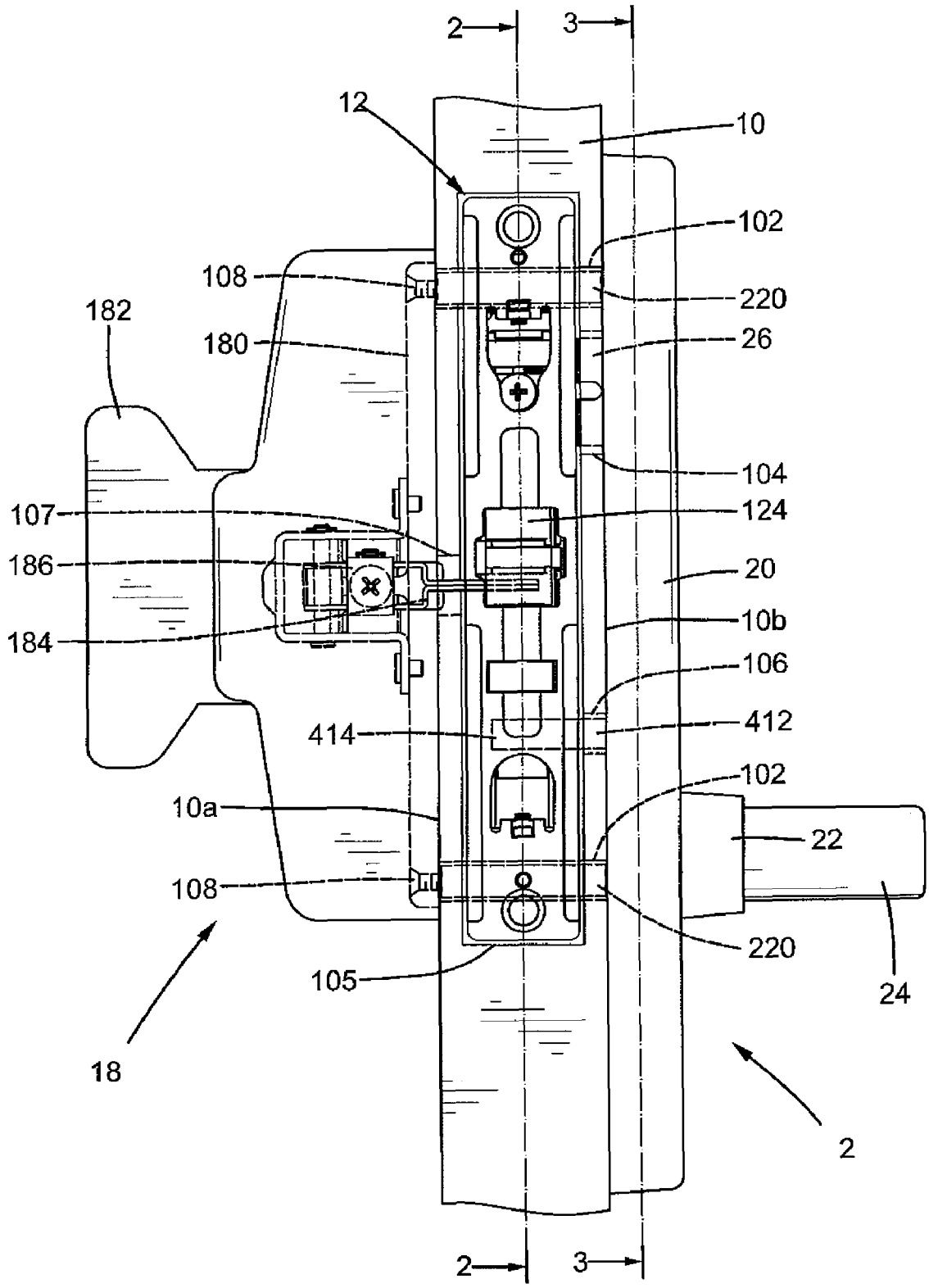
FIG. 1 shows a partial, side elevational view of a panic exit door, a lock mounted to a side of the door, and an outer operational device according to the preferred teachings of the present invention mounted to the other side of the door.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "side", "end", "portion", "section", "axial", "lateral", "horizontal", "vertical", "annular", "inward", "spacing", "clockwise", "counterclockwise", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An outer operational device according to the preferred teachings of the present invention is shown in the drawings and generally designated 2 and adapted to be mounted to a side of a door 10. According to the preferred form shown, door 10 includes an inner side 10*a* and an outer side 10*b*. It is noted that inner and outer sides 10*a* and 10*b* are exchanged when door 10 is installed as a differently handed door. According to the most preferred form shown in FIG. 1, door 10 is installed as a right-handed door. Furthermore, door 10 includes a mounting hole 105 in an edge extending between inner side 10*a* and outer side 10*b*. Door 10 further includes a plurality of first holes 102 extending from inner side 10*a* through outer side 10*b*. Door 10 further includes a second hole 104 and a third hole 106 in outer side 10*b* and a fourth hole 107 in inner side 10*a*. Each of holes 102, 104, 106, and 107 is in communication with mounting hole 105. A lock 12 in the most preferred form shown as a mortise lock is mounted in mounting hole 105. An inner operational device 18 is mounted to inner side 10*a* of door 10, and outer operational device 2 according to the preferred teachings of the present invention is mounted to outer side 10*b* of door 10. Lock 12 and inner operational device 18 can be of any desired form as conventional including but not limited to of a commercially available type.

According to the preferred form shown, lock 12 includes a case 122 mounted in mounting hole 105 of door 10 and having an opening 123 in a lower end thereof. Case 122 further includes a sliding groove 127 in a side thereof. A retractor 120 is slideably received in case 122 and partially and slideably received in sliding groove 127. A spring 125 is mounted between retractor 120 and a latch 124, allowing latch 124 to move between an extended, locking position outside of case 122 and a retracted, unlocking position inside of case 122 responsive to sliding movement of retractor 120.

According to the preferred form shown, an unlocking member 148 is pivotably mounted in case 122 below latch 124. Unlocking member 148 is substantially T-shaped and includes first, second, and third arms 152, 154, and 156. A hole 150 is formed in a center of unlocking member 148.

According to the preferred form shown, a push rod 144 is pivotably mounted in case 122 and adjacent to unlocking member 148. Push rod 144 is arcuate and includes an end 146 abutting retractor 120. The other end of push rod 144 is pivotably connected to case 122. First arm 152 of unlocking member 148 abuts a side of push rod 144. In the most preferred form shown, push rod 144 can only be pushed by first arm 152 to pivot when unlocking member 148 rotates in the counterclockwise direction in FIG. 2. Namely, push rod 144 is not moved if unlocking member 148 rotates in the clockwise direction.

According to the preferred form shown, a locking member 160 is slideably received in case 122 and includes a horizontal guide slot 164 in an upper portion thereof. Locking member 160 includes a stop 162 at a lower portion thereof. A transmission block 128 and a rocker 166 are pivotably mounted in case 122. Specifically, an end of transmission block 128 is overlapped with a portion of rocker 166 and pivotably received in case 122. Rocker 166 has an end 169 slideably received in guide slot 164 of locking member 160. Thus, when transmission block 128 pivots, rocker 166 pivots and, thus, moves locking member 160 to move stop 162 of locking member 160 between an unlocking position away from second arm 154 of unlocking member 148 and a locking position that is behind second arm 154 to prevent movement of second arm 154. A pressing rod 168 is pivotably mounted in case 122 and abuts a lower portion of third arm 156. Pressing rod 168 can be coupled through a lift arm to a handle, so that operation of the handle causes pivotable movement of unlocking member 148 through third arm 156. However, pressing rod 168 can be omitted without adversely affecting operation of outer operational device 2 according to the teachings of the present invention.

According to the preferred form shown, inner operational device 18 includes a base 180, a driving rod 184 pivotably mounted to base 180, and a linking rod 186 slideably received in base 180. An operative member 182 in the most preferred form shown as a press bar is pivotably mounted outside of base 180 and operably connected to linking rod 186. An end of driving rod 184 is extended through fourth hole 107 of door 10 and sliding groove 127 into case 122 of lock 12 and abuts a side of retractor 120. When operative member 182 is actuated, linking rod 186 is moved to draw driving rod 184, which in turn, moves retractor 120. Thus, latch 124 is moved from the extended, locking position to the retracted, unlocking position for unlocking purposes.

For safety consideration, operative member 182 of inner operational device 18 for a panic exit door has a large area to allow easy access and operation by a user. Furthermore, in urgent conditions, door 10 will be opened by operating operative member 182 whether lock 12 is in the locking state or unlocking state. Outer operational device 2 according to the preferred teachings of the present invention provides a burglarproof function and allows opening door 10 from the outside.

According to the preferred form shown, outer operational device 2 includes a cover 20 having a sidewall 202 extending in a vertical direction and an annular wall 204 extending perpendicularly along a periphery of sidewall 202, defining a space 200 between annular wall 204 and sidewall 202. Sidewall 202 includes a receiving portion 205 in an upper portion thereof. Receiving portion 205 extends into space 200 and forms a compartment 206 that has an opening 208 in communication with space 200. Sidewall 202 further includes a fixing hole 210 below opening 208. Sidewall 202 further includes an engaging hole 214 below fixing hole 210. A protrusion 215 extends from an inner face of sidewall 202 below engaging hole 214 and includes a groove 216. Two pegs 218 are formed on the inner face of sidewall 202 and located above opening 208. Annular wall 204 includes two supports 217 on two inner, vertical faces thereof. Each support 217 has a height from sidewall 202 the same as that of protrusion 215.

Two mounting posts 220 are extended through two of first holes 102 of door 10 into screw holes in pegs 218. Furthermore, two additional mounting posts 220 are extended through the other two first holes 102 into screw holes in protrusions 215. Cover 20 is mounted to outer side 10*b* of door 10 and covers first, second, and third holes 102, 104, and 106 with annular wall 204 abutting outer side 10*b*. Each mounting post 220 has an end abutting base 180. A fastener 108 is extended through base 180 into a screw hole in the end of each mounting post 220.

According to the preferred form shown, outer operational device 2 further includes a substantially cylindrical sleeve 22 mounted to an outer face of sidewall 202. Sleeve 22 includes a central pivot hole 222 aligned with engaging hole 214 of cover 20. Fasteners 224 are extended through sidewall 202 into holes 226 in an end face of sleeve 22 to fix sleeve 22 on cover 20.

According to the preferred form shown, outer operational device 2 further includes a handle 24 having a stem 240 adapted to be gripped by a user and a shank 242 extending from an end of stem 240. Shank 242 includes an engaging portion 244 in the most preferred form shown having two chamfered faces 246 so that engaging portion 244 has noncircular cross sections. Shank 242 is pivotably received in pivot hole 222 of sleeve 22 about a pivot axis with engaging portion 244 outside of pivot hole 222. A retainer ring 248 in the most preferred form shown as a C-clip is mounted around shank 242 to prevent axial movement of handle 24 along the pivot axis.

According to the preferred form shown, outer operational device 2 further includes an actuating member 36 having a connecting hole 364 in an intermediate portion thereof. Two diametrically opposed rectangular grooves 366 are formed in an inner periphery of connecting hole 364. Actuating member 36 further includes first and second ends 360 and 362 on opposite sides of connecting hole 364. Shank 242 of handle 24 is pivotably received in connecting hole 364, so that actuating member 36 is pivotable relative to shank 242 of handle 24. A first axle 368 is formed on a side of first end 360 of actuating member 36 facing cover 20, and a second axle 368 is formed on a side of second end 362 of actuating member 36 facing cover 20.

According to the preferred form shown, outer operational device 2 further includes a follower 38 in the most preferred form shown as a ring. Follower 38 includes a non-circular hole 382 corresponding to non-circular engaging portion 244 of handle 24 and extending along a central axis thereof. Follower 38 further includes two diametrically opposed teeth 380 extending in a direction parallel to and spaced from the central axis of follower 38. Engaging portion 244 of handle 24 is received in non-circular hole 382 of follower 38, with follower 38 located outside of actuating member 36 and with teeth 380 engaged in grooves 366. Thus, handle 24 and follower 38 rotate jointly due to non-circular hole 382 and non-circular engaging portion 244. Furthermore, since teeth 380 of follower 38 are engaged in grooves 366 of actuating member 36, rotation of handle 24 also causes rotation of actuating member 36.

According to the preferred form shown, outer operational device 2 further includes a driving member 40 including a pivotal portion 410 in the most preferred form shown as a rod. Pivotal portion 410 includes a non-circular hole 406 and diametrically opposed first and second wings 402 and 404 on an outer periphery thereof. Each of first and second wings 402 and 404 includes a peg 408 facing cover 20. An end of pivotal portion 410 is pivotably received in fixing hole 210 of cover 20, such that driving member 40 is rotatable about a central axis of fixing hole 210.

According to the preferred form shown, outer operational device 2 further includes two links 34 each having upper and lower ends 340 and 342. Upper end 340 of first link 34 is pivotably coupled with peg 408 of first wing 402 between first wing 402 and sidewall 202. Upper end 340 of second link 34 is pivotably coupled with peg 408 of second wing 402 between second wing 404 and sidewall 202. Lower end 342 of first link 34 is pivotably coupled with first axle 368 of actuating member 36 between first end 360 of actuating member 36 and sidewall 202. Lower end 342 of second link 34 is pivotably coupled with second axle 368 of actuating member 36 between second end 362 of actuating member 36 and sidewall 202.

According to the preferred form shown, outer operational device 2 further includes a driving rod 412 having front and rear ends 414 and 416. Rear end 416 of driving rod 412 is extended through non-circular hole 406 of driving member 40 and includes non-circular cross sections corresponding to non-circular hole 406, so that driving rod 412 rotates together with driving member 40. Front end 414 of driving rod 412 is extended through third hole 106 into hole 150 of unlocking member 148, so that rotation of driving rod 412 also causes rotation of unlocking member 148.

According to the preferred form shown, outer operational device 2 further includes an inner lid 46 having an opening 462 through which engaging portion 244 of handle 24 extends. A bend 466 is formed on an inner periphery of opening 462. Inner lid 46 further includes a through-hole 464 above opening 462. Inner lid 46 abuts protrusion 215 and supports 217, and fasteners 468 are extended through inner lid 46 into screw holes in supports 217. Two of mounting posts 220 are extended through inner lid 46 into screw holes in protrusion 215. Thus, inner lid 46 is fixed in space 200 of cover 20. The other end of pivotal portion 410 is pivotably received in through-hole 464 of inner lid 46 to support stable rotation of driving member 40.

According to the preferred form shown, outer operational device 2 further includes a returning device 28 having a body 296 with a non-circular outer periphery. Body 296 includes a lobe 300 on a lower end thereof and having rectangular cross sections. Lobe 300 is received in groove 216 of cover 20 to prevent rotation of body 296. Body 296 further includes a compartment 298 in a side thereof. Compartment 298 forms an engaging groove 302 in lobe 300. A bottom wall defining compartment 298 includes a pivot hole 308. Two limiting blocks 304 are formed on the side of body 296 along a periphery of pivot hole 308. Each limiting block 304 includes an end 306. Furthermore, each limiting block 304 has a height to the side of body 296 smaller or equal to a depth of compartment 298. A housing 282 slightly larger than body 296 is mounted to the side of body 296 to cover compartment 298. Housing 282 includes an axial hole 284 aligned with pivot hole 308.

According to the preferred form shown, returning device 28 further includes a substantially cylindrical rotatable member 280 having a flange 288 on an intermediate portion of an outer periphery thereof. Two pivotal sections 290 are formed on opposite sides of flange 288. Also formed on the outer periphery of rotatable member 280 are first and second blocks 286 adjacent two ends of flange 288. A slit 294 is formed between flange 288 and first block 286. Rotatable member 280 further includes a non-circular hole 292 through which engaging portion 244 of handle 24 extends. Pivotal sections 290 are respectively and pivotably received in pivot hole 308 of body 296 and axial hole 284 of housing 282 with blocks 286 located between limiting blocks 304. The spacing between limiting blocks 304 and blocks 286 limits rotation of rotatable member 280.

According to the preferred form shown, returning device 28 further includes an elastic element 312 in the form of a spiral spring having a spiral section, a first, outer tang 314 outside of the spiral section, and a second, inner tang 316 inside of the spiral section. The spiral section of elastic element 312 is mounted around limiting blocks 304 and located in compartment 298 with first, outer tang 314 abutting against a wall of engaging groove 302 and with second, inner tang 316 received in slit 294 of rotatable member 280 and abutting against a side of first block 286 adjacent slit 294. Thus, first, outer tang 314 is fixed to body 296, and second, inner tang 316 is fixed in slit 294. Rotatable member 280 is biased by elastic element 312 so that each of first and second blocks 286 presses against end 306 of one of limiting blocks 304. In this state, stem 240 of handle 24 is in a horizontal state with rotatable member 280 in its initial position. When rotatable member 280 is rotated, first block 286 adjacent to slit 294 presses against second, inner tang 316 of elastic element 312 to store the restoring force.

In the most preferred form shown, rotatable member 280 of returning device 28 operates in a single direction according to the moving direction of unlocking member 148 and push rod 144. Specifically, rotatable member 280 can only rotate jointly with unlocking member 148 in the counterclockwise direction in FIG. 3. Clockwise rotation of rotatable member 280 is stopped by one of limiting blocks 304.

Returning device 28 is received in opening 462 of inner lid 46 and abuts against bend 466. Engaging portion 244 of handle 24 is extended through non-circular hole 292 of rotatable member 280. A fastener 250 is threadedly engaged in a screw hole in an end face of engaging portion 244 and includes a head abutting against rotatable member 280, such that returning device 28 can not move along engaging portion 244. Namely, movement of returning device 28 along a rotating axis about which rotatable member 280 rotates is prevented. Thus, follower 38 and actuating member 36 are retained in place. Due to non-circular coupling between engaging portion 244 and rotatable member 280, elastic element 312 is twisted by rotatable member 280 when handle 24 is rotated. When handle 24 is released, elastic element 312 returns rotatable member 280 to its initial position and returns handle 24 to its initial, horizontal position. Limiting blocks 304 limit rotational movement of handle 24 to be smaller than 45° in either direction. According to the preferred form shown, handle 24 can rotate 40° in a counterclockwise direction.

According to the preferred form shown, outer operational device 2 further includes a cylinder 26 including a cylindrical body 264 having a flange 262 on an end face thereof. A front end of an outer periphery of body 264 includes a threaded portion 266. The outer periphery of body 264 further includes two diametrically opposed V-shaped positioning grooves 268. A lock core 270 is received in body 264. An actuator 272 is provided on the other end face of body 264 and fixed to lock core 270 to rotate therewith. Cylinder 26 is received in compartment 206 of cover 20 with flange 262 abutting a bottom wall of compartment 206. Body 264 is extended through opening 208 of cover 20 and second hole 104 of door 10 into mounting hole 105 of door 10 with threaded portion 266 received in case 122 of lock 12 and with each positioning groove 268 engaged with one of two protrusions 121 of lock 12.

During installation of outer operational device 2, driving rod 412 is extended through hole 150 of unlocking member 148 of lock 12, as mentioned above. Thus, even if outer operational device 2 is not aligned with lock 12 during installation, adjustment of positions of lock 12 and inner and outer operational devices 18 and 2 is not required, allowing convenient on-site installation.

Figure 2:
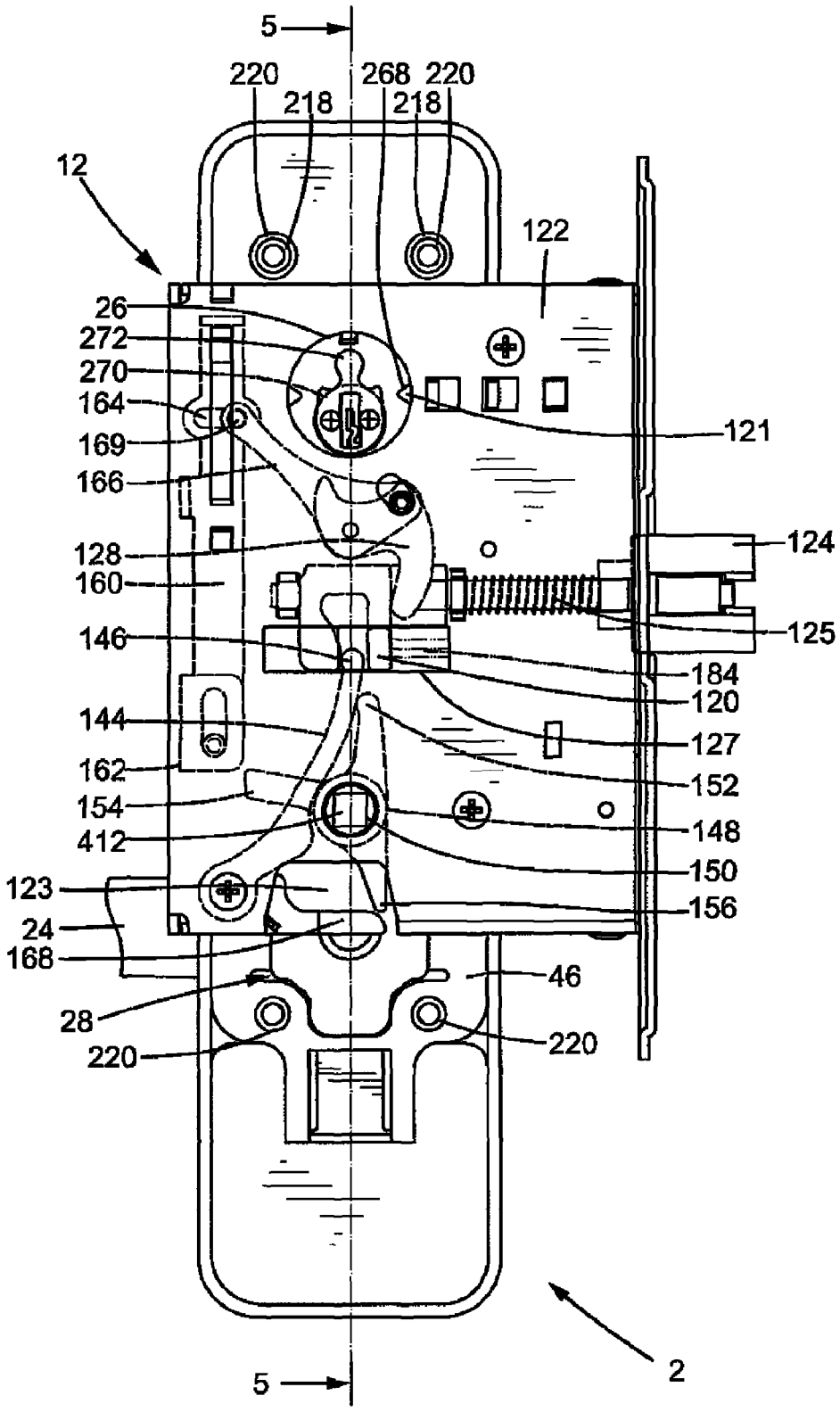
FIG. 2 shows a cross sectional view according to section line 2-2 of FIG. 1 with the lock in a locking state.
Figure 3:
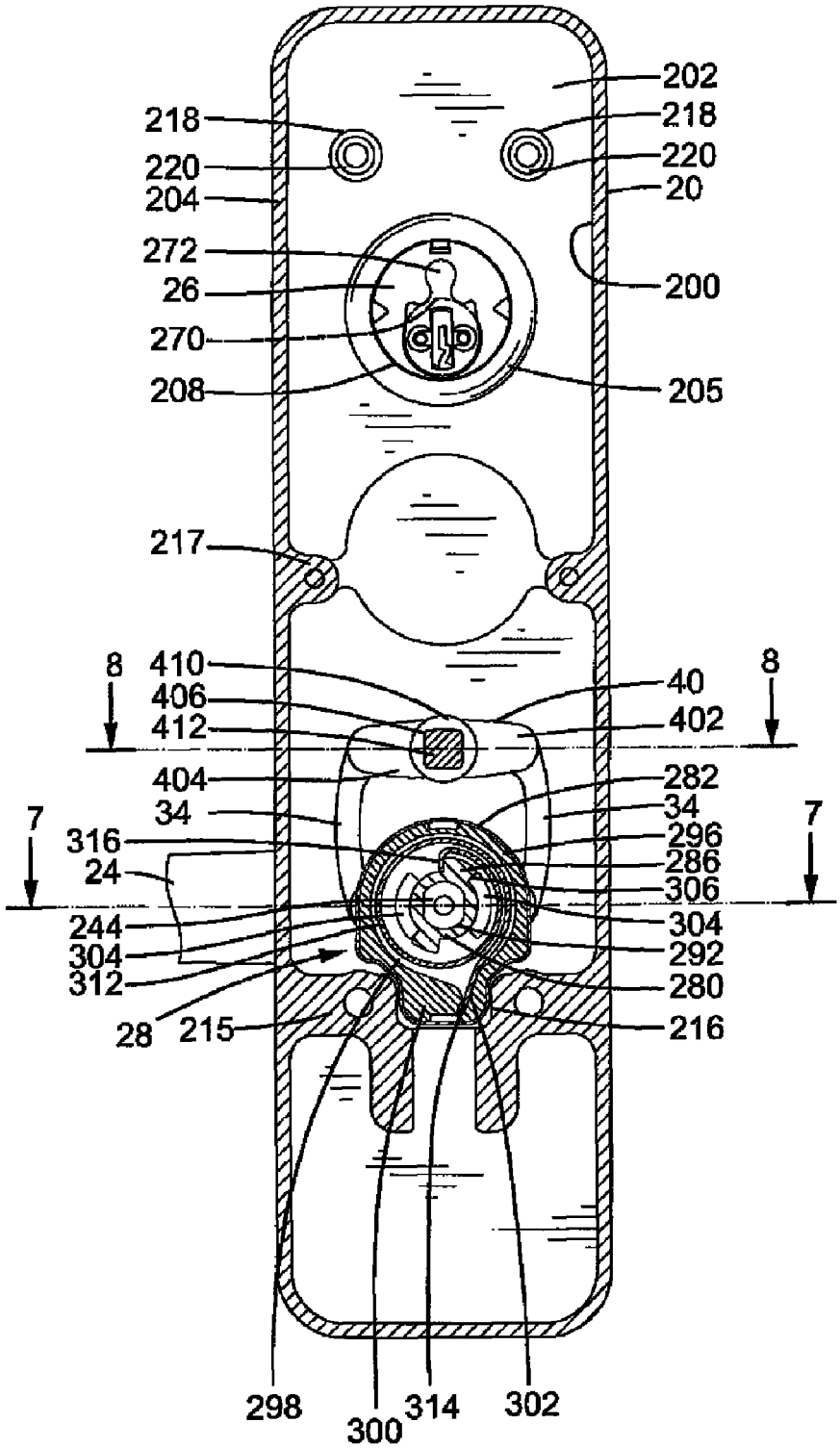
FIG. 3 shows a cross sectional view according to section line 3-3 of FIG. 1.
Figure 4:
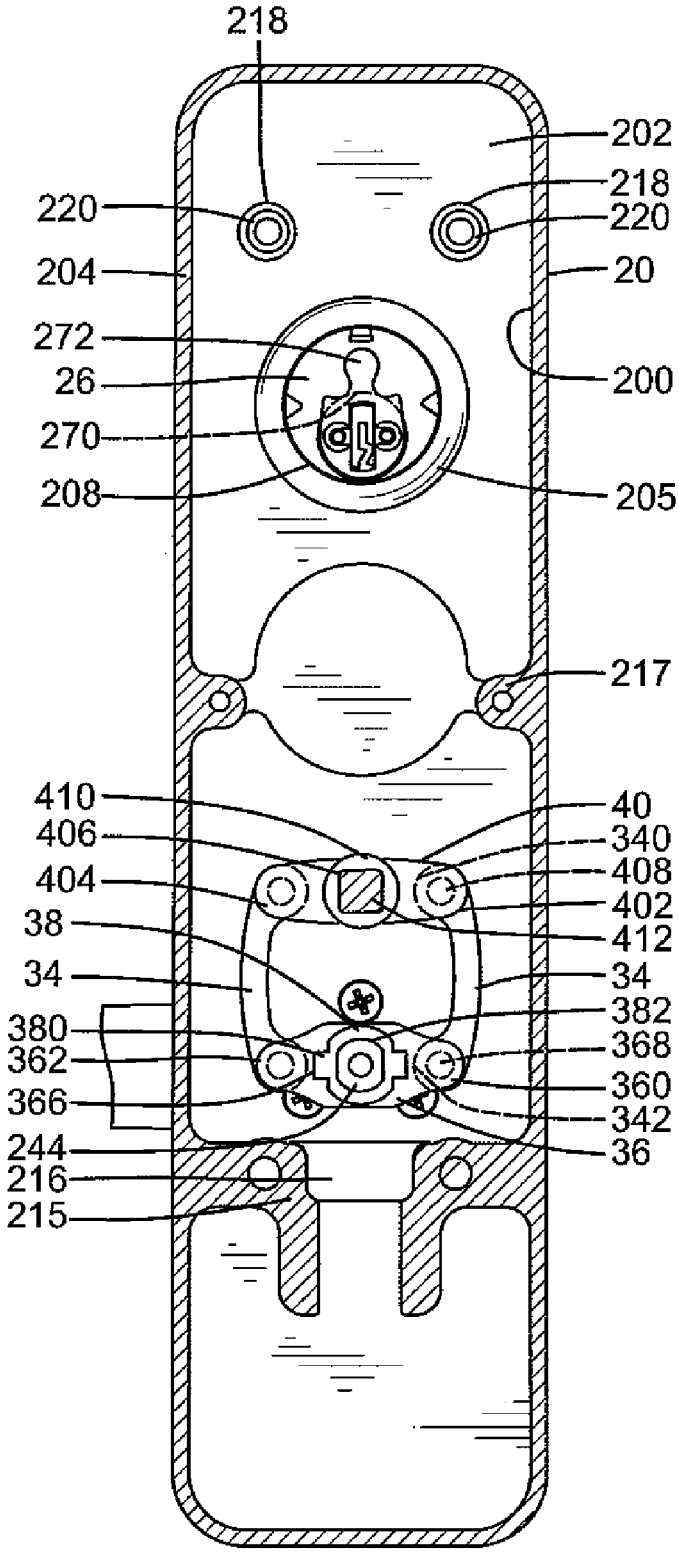
FIG. 4 shows a view similar to FIG. 3 with a returning device of the outer operational device removed.
Figure 5:
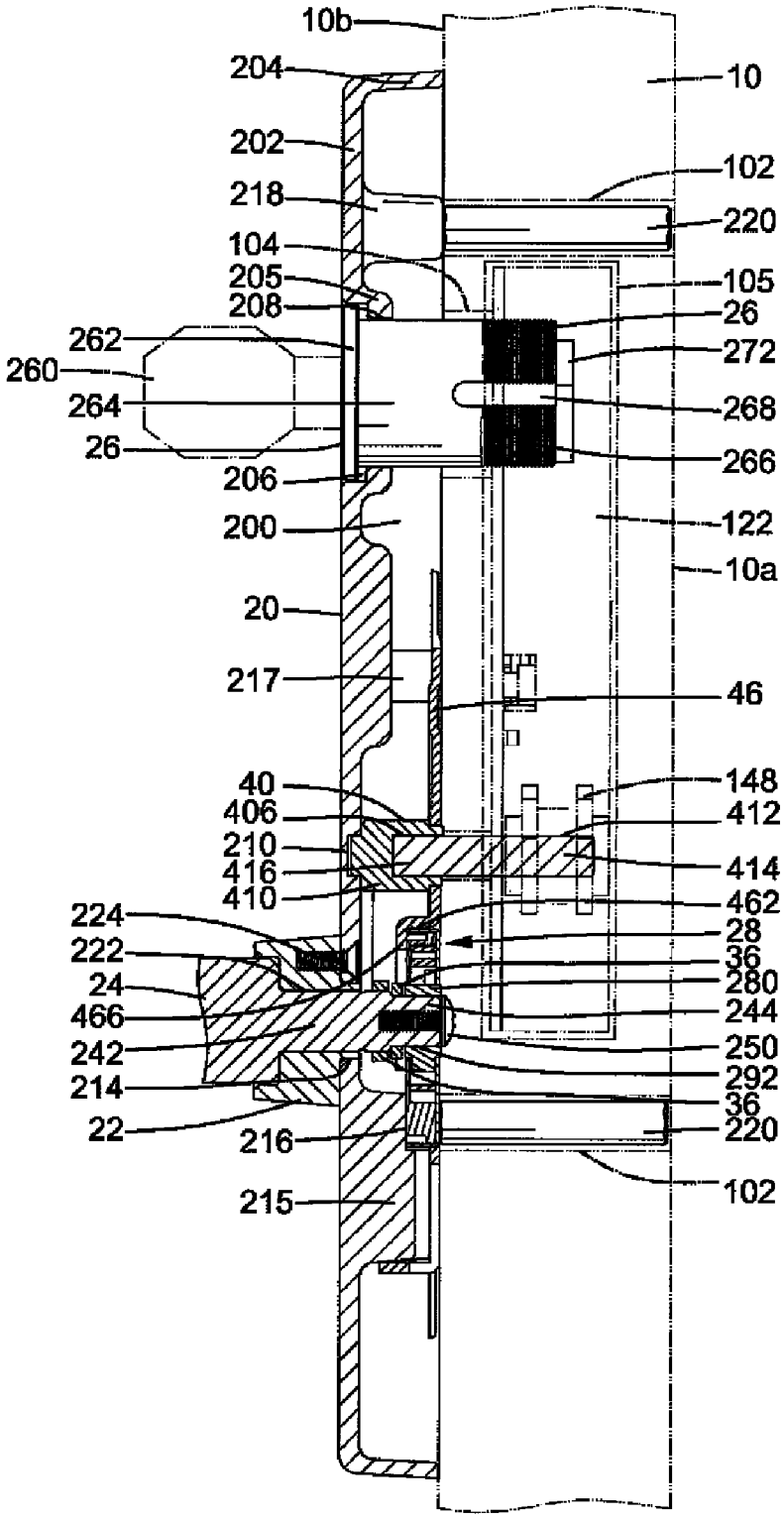
FIG. 5 shows a cross sectional view according to section line 5-5 of FIG. 2.
Figure 6:
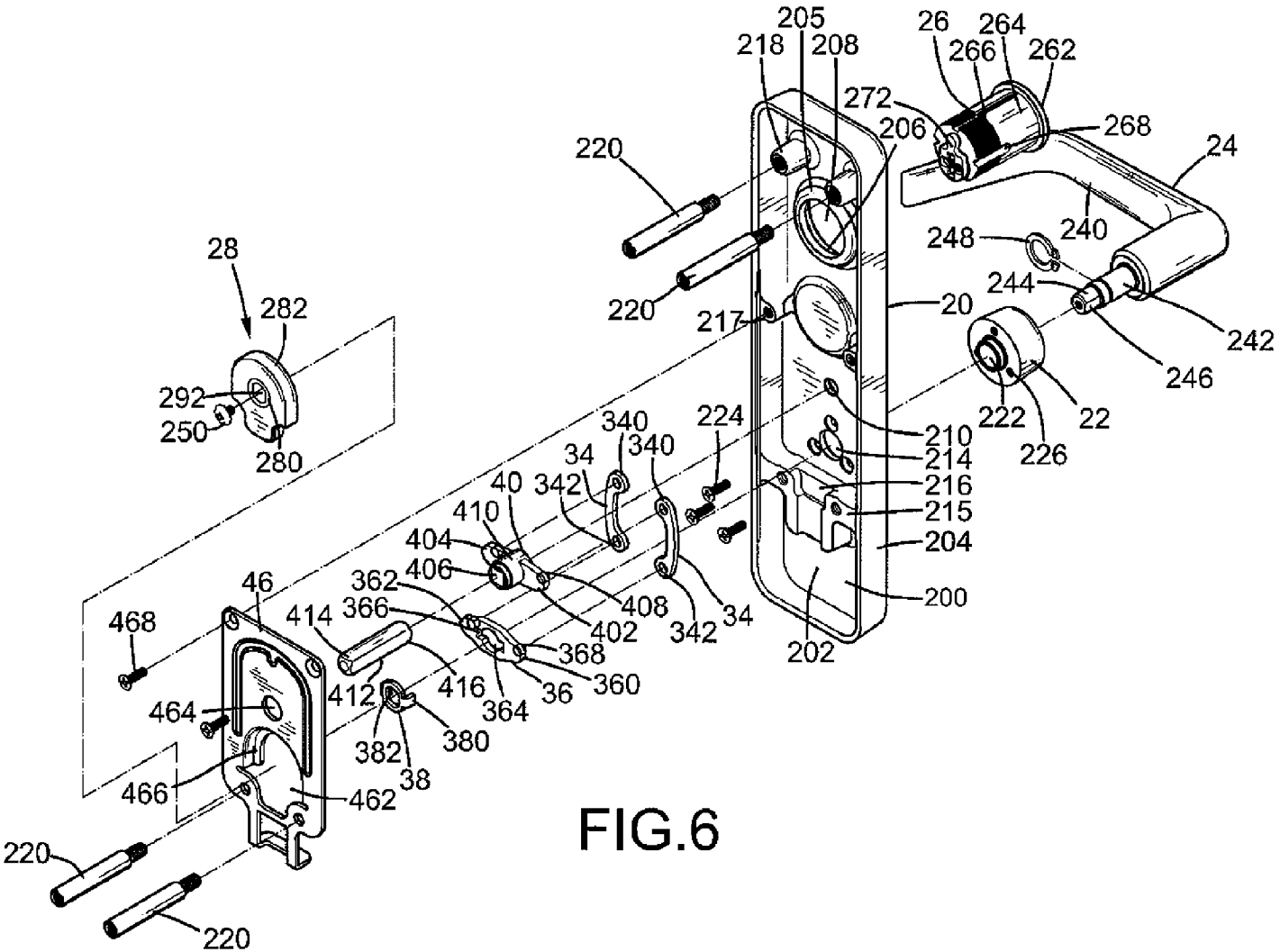
FIG. 6 shows an exploded, perspective view of the outer operational device of FIG. 1.
Figure 7:
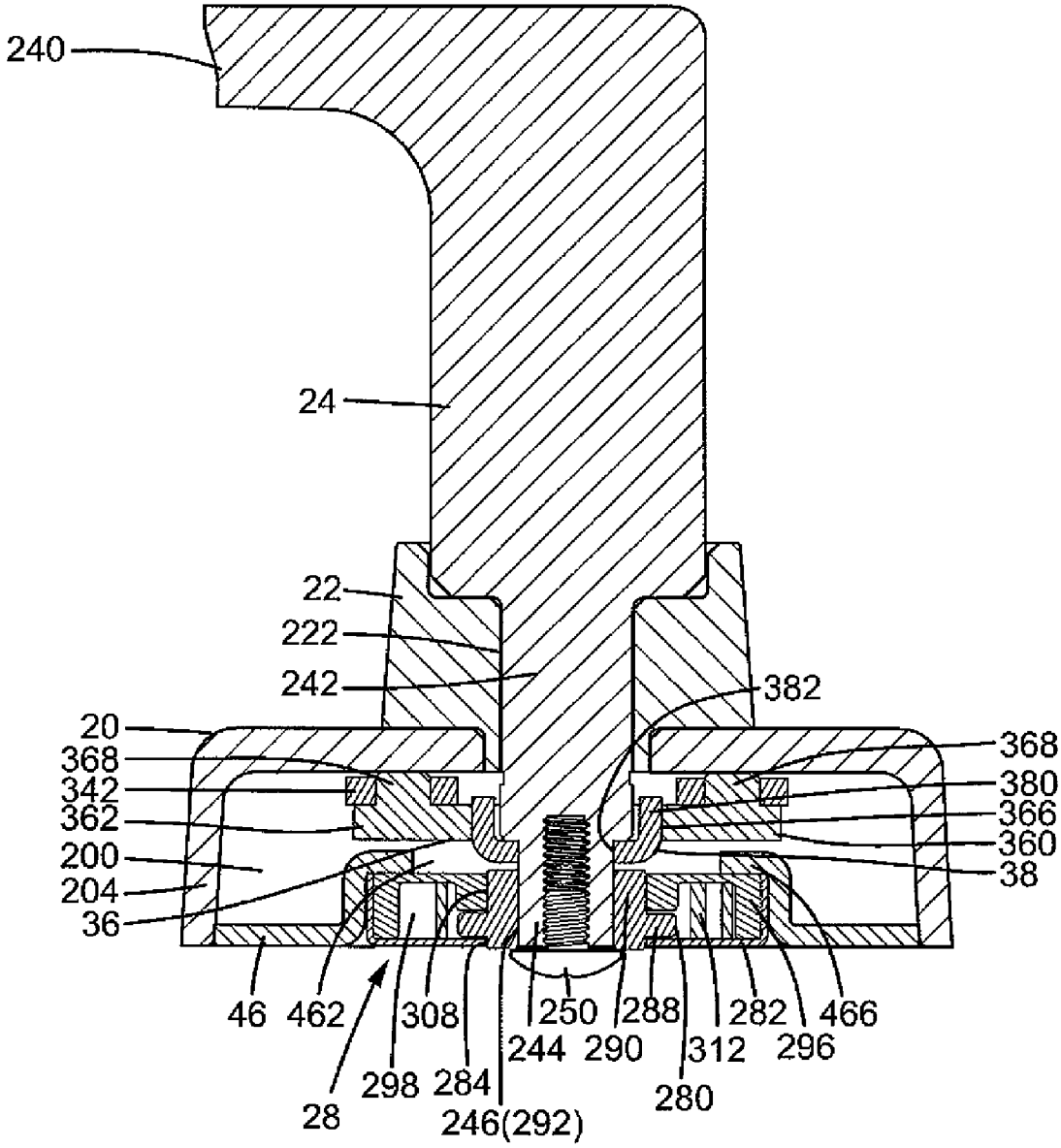
FIG. 7 shows a cross sectional view according to section line 7-7 of FIG. 3.
Figure 8:
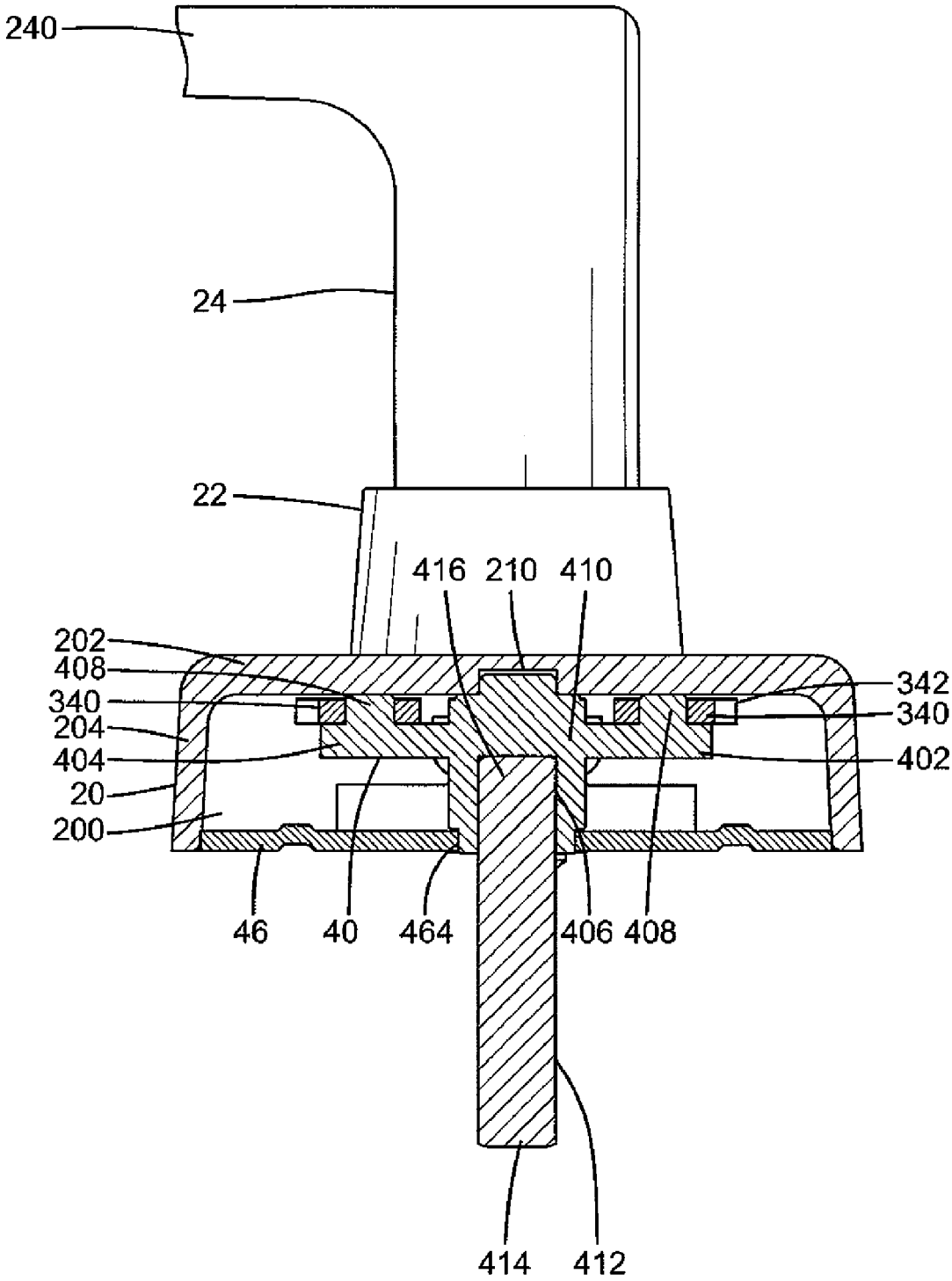
FIG. 8 shows a cross sectional view according to section line 8-8 of FIG. 3.
Figure 9:
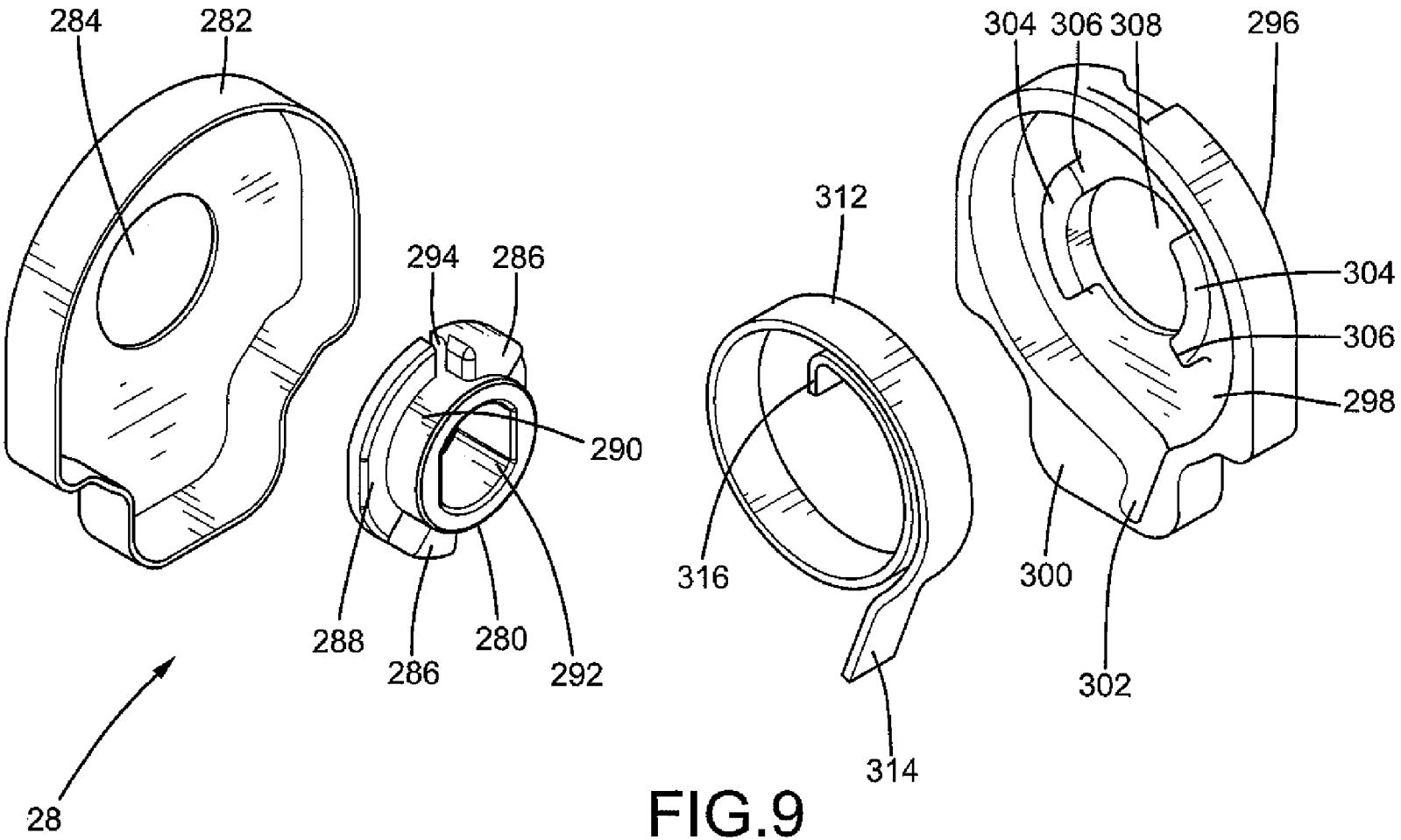
FIG. 9 shows an exploded, perspective view of the returning device of the outer operational device of FIG. 1.
Figure 11:
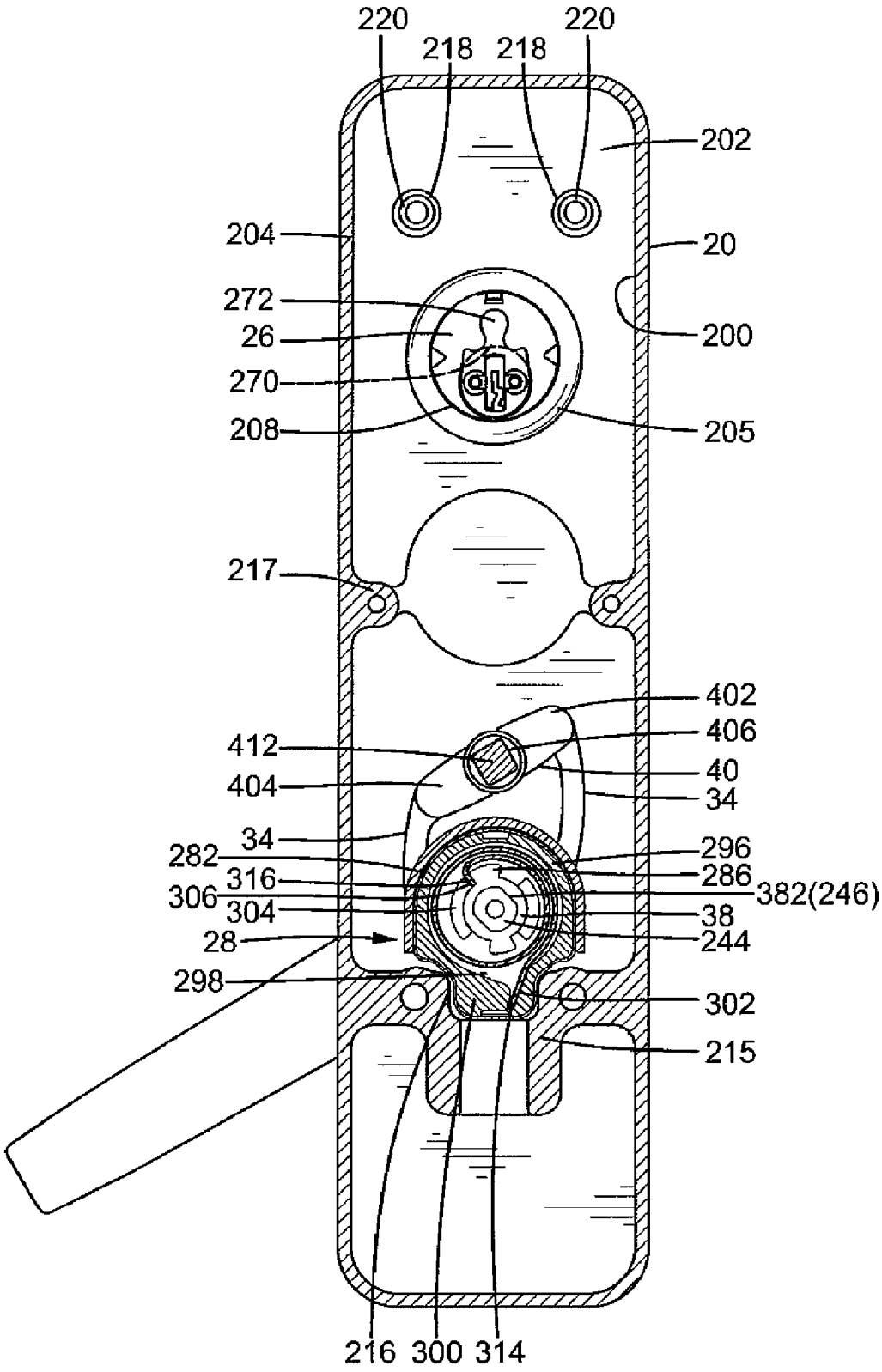
FIG. 11 is a view similar to FIG. 3 with the handle operated for unlocking purposes.
Figure 12:
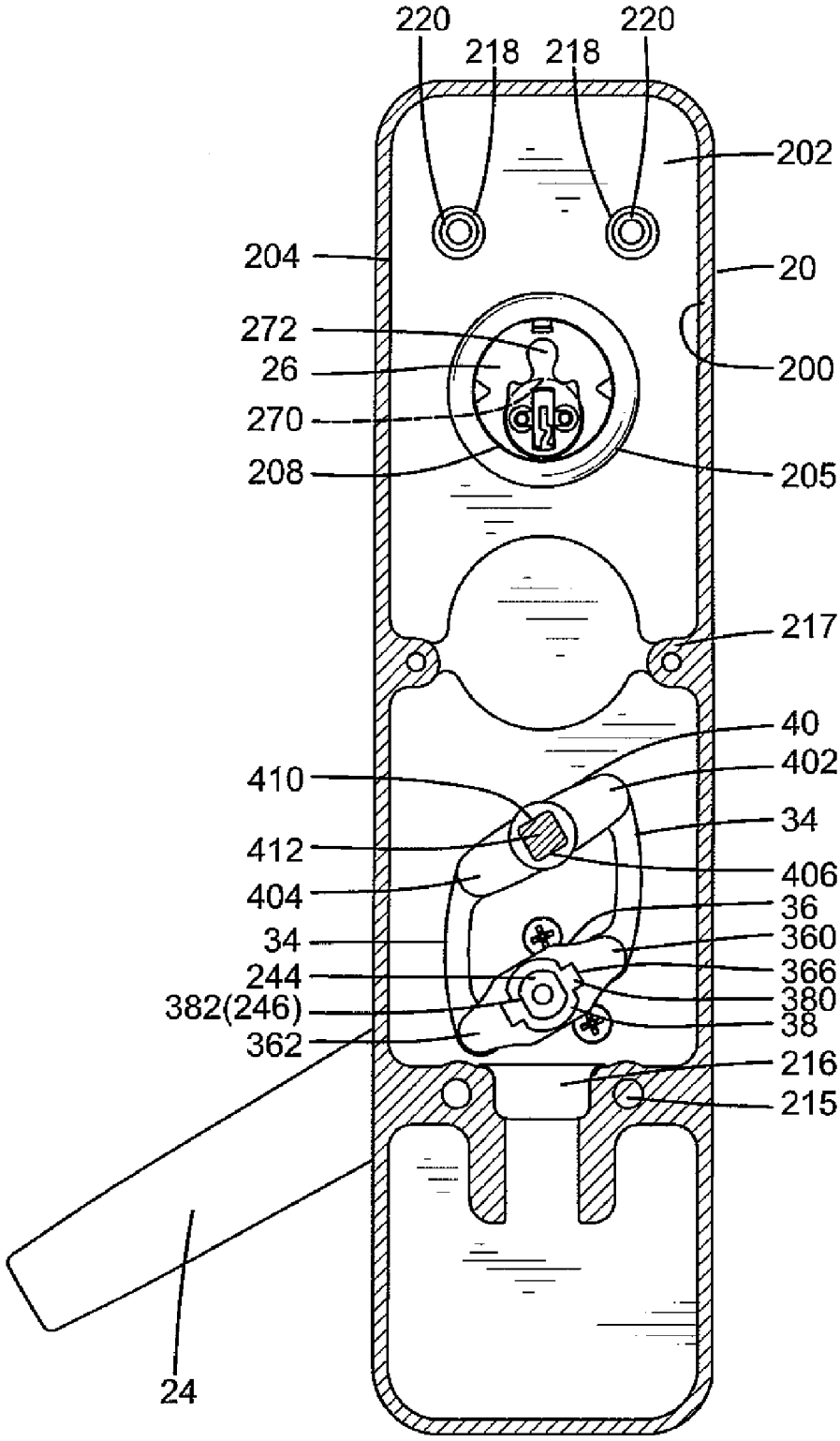
FIG. 12 is a view similar to FIG. 4 with the handle operated for unlocking purposes.

Now that the basic construction of outer operational device 2 of the preferred teachings of the present invention has been explained, the operation and some of the advantages of outer operational device 2 can be set forth and appreciated. In particular, for the sake of explanation, it will be assumed that handle 24 is in a horizontal position (FIGS. 2-4). Due to limitation by returning device 28, handle 24 can only pivot in the counterclockwise direction of FIG. 2. When handle 24 is pivoted in the counterclockwise direction, follower 38 and rotatable member 280 of returning device 28 rotate jointly with engaging portion 244, so that first block 286 moves second, inner tang 316 of elastic element 312 and that elastic element 312 is twisted to store potential energy for returning purposes. Actuating member 36 is rotated by teeth 380 of follower 38. Links 34 are driven by axles 368 of actuating member 36 to move in a reverse direction. One of links 34 moves upward to push first wing 402, and the other link 34 moves downward to push second wing 404, so that driving member 40 rotates in the counterclockwise direction. At the same time, driving rod 412 rotates jointly with driving member 40, so that front end 414 of driving rod 412 actuates unlocking member 148 of lock 12 to move in the counterclockwise direction. First arm 152 drives push rod 144 to rotate, and end 146 of push rod 144 pushes retractor 120 to move in a leftward direction in FIG. 2 to compress spring 125. When rotatable member 280 rotates to an extreme position in which one of blocks 286 abuts against end 306 of one of limiting blocks 304, latch 124 is moved from the extended, locking position to the retracted, unlocking position (FIGS. 10-12).

Figure 10:
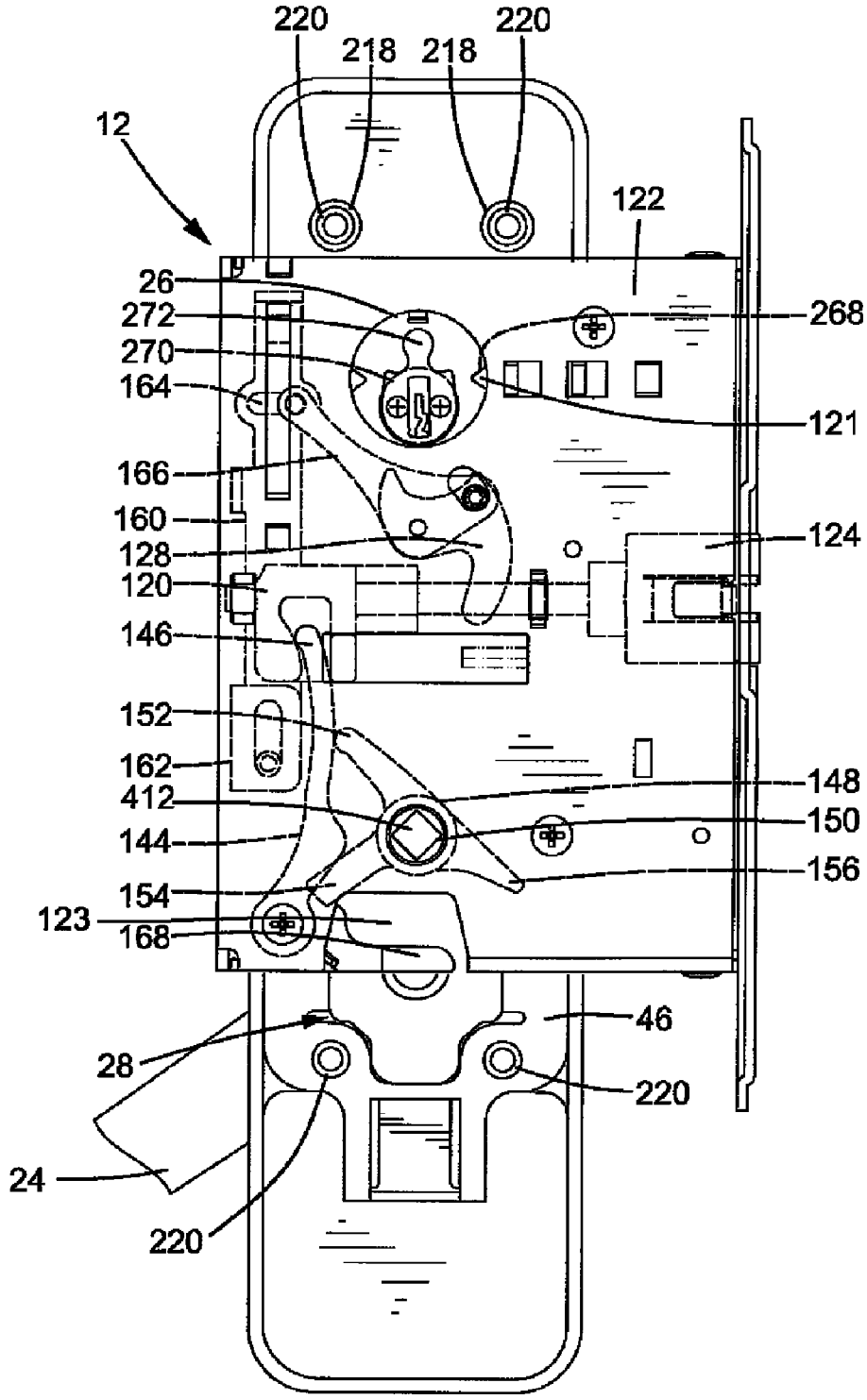
FIG. 10 is a view similar to FIG. 2 with a handle operated for unlocking purposes.

When handle 24 is released after unlocking, second, inner tang 316 of elastic element 312 returns rotatable member 280 from the extreme position back to the initial position, which in turn, rotates handle 24 in a clockwise direction in FIG. 10 to its initial position via engaging portion 244. Thus, stem 240 of handle 24 returns to its horizontal position, and first and second ends 360 and 362 of actuating member 36 are at the same level. Furthermore, latch 124 is moved by spring 125 to the extended, locking position. At the same time, links 34 move first wing 402 and second wing 404 in opposite directions until first and second wings 402 and 404 are at the same level.

Figure 13:
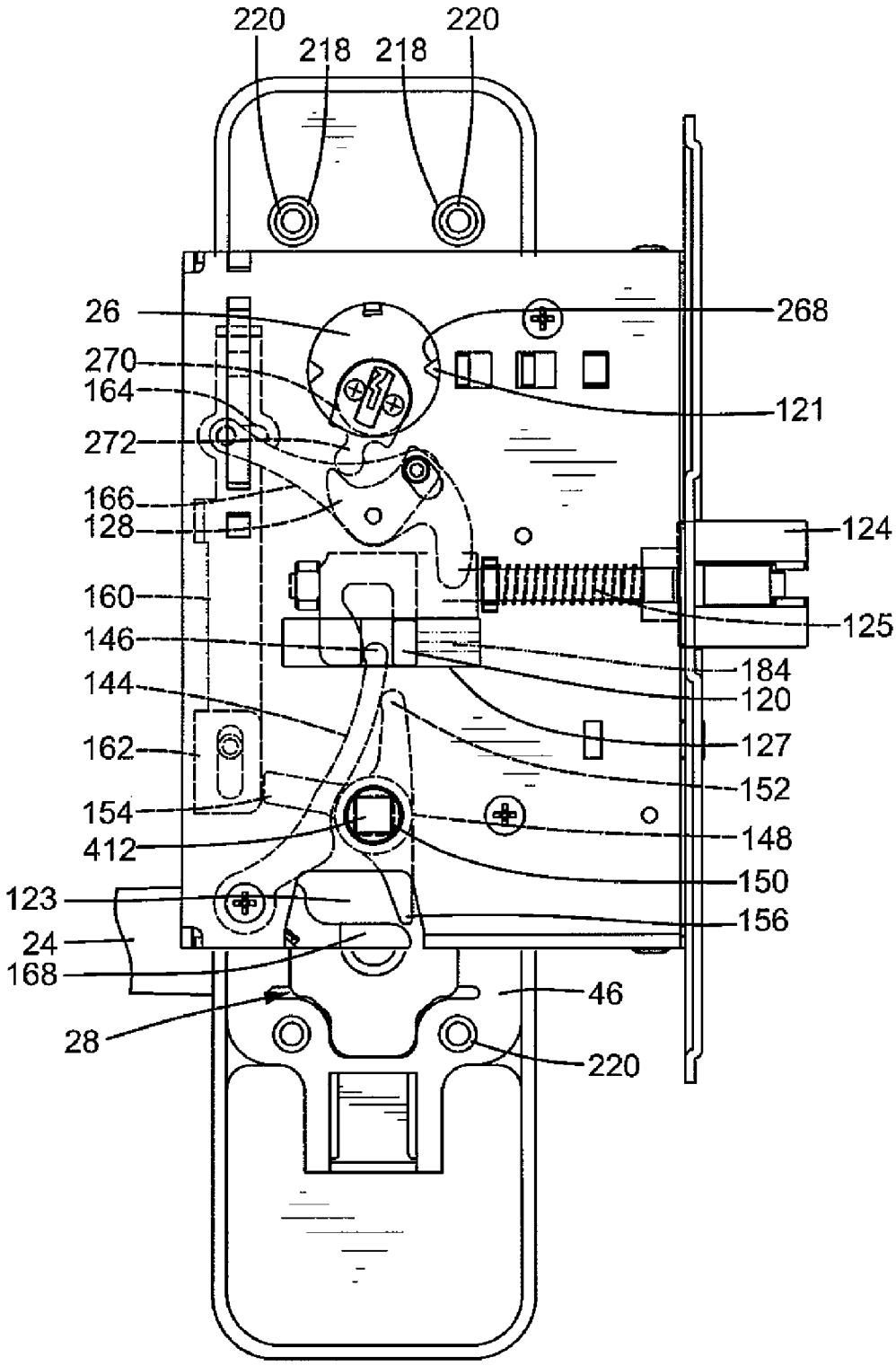
FIG. 13 is a view similar to FIG. 2 with an actuator moved to a position to provide a burglarproof function.

It can be appreciated that outer operational device 2 according to the preferred teachings of the present invention provides a burglarproof function, so that latch 124 of lock 12 can not be moved to the retracted, unlocking position by operating outer operational device 2. Specifically, actuator 272 of cylinder 26 is initially located above transmission block 128 of lock 12 (FIGS. 2-5). When the burglarproof function is required, a key 260 is inserted into lock core 270 in cylinder 26 to unlock and rotate lock core 270, so that actuator 272 is rotated in the clockwise direction in FIG. 2 to press against transmission block 128. Transmission block 128 moves in the counterclockwise direction in FIG. 2, which in turn, causes counterclockwise movement of rocker 166. End 169 of rocker 166 slides in guide slot 164 of locking member 160 and moves locking member 160 in a direction so that stop 162 of locking member 160 is moved from its unlocking position away from second arm 154 of unlocking member 148 to its locking position behind second arm 154 (FIG. 13).

When locking member 160 is in its locking position (FIG. 13), stop 162 abuts a face of second arm 154, such that movement of second arm 154 of unlocking member 148 is stopped by stop 162 when handle 24 is rotated in the counterclockwise direction. Namely, unlocking door 10 by rotating handle 24 is not allowed.

When it is desired to remove the burglarproof setting, the key 260 is inserted into lock core 270 in cylinder 26 to rotate lock core 270 in a reverse direction, so that actuator 272 is rotated in the counterclockwise direction. End 169 of rocker 166 slides in guide slot 164 of locking member 160 and moves locking member 160 in a reverse direction so that stop 162 of locking member 160 is moved from its locking position behind second arm 154 to its unlocking position away from second arm 154 of unlocking member 148 (FIG. 2). Movement of unlocking member 148 is no longer blocked by stop 162 of locking member 160 so that handle 24 can be rotated for opening door 10.

Figure 14:
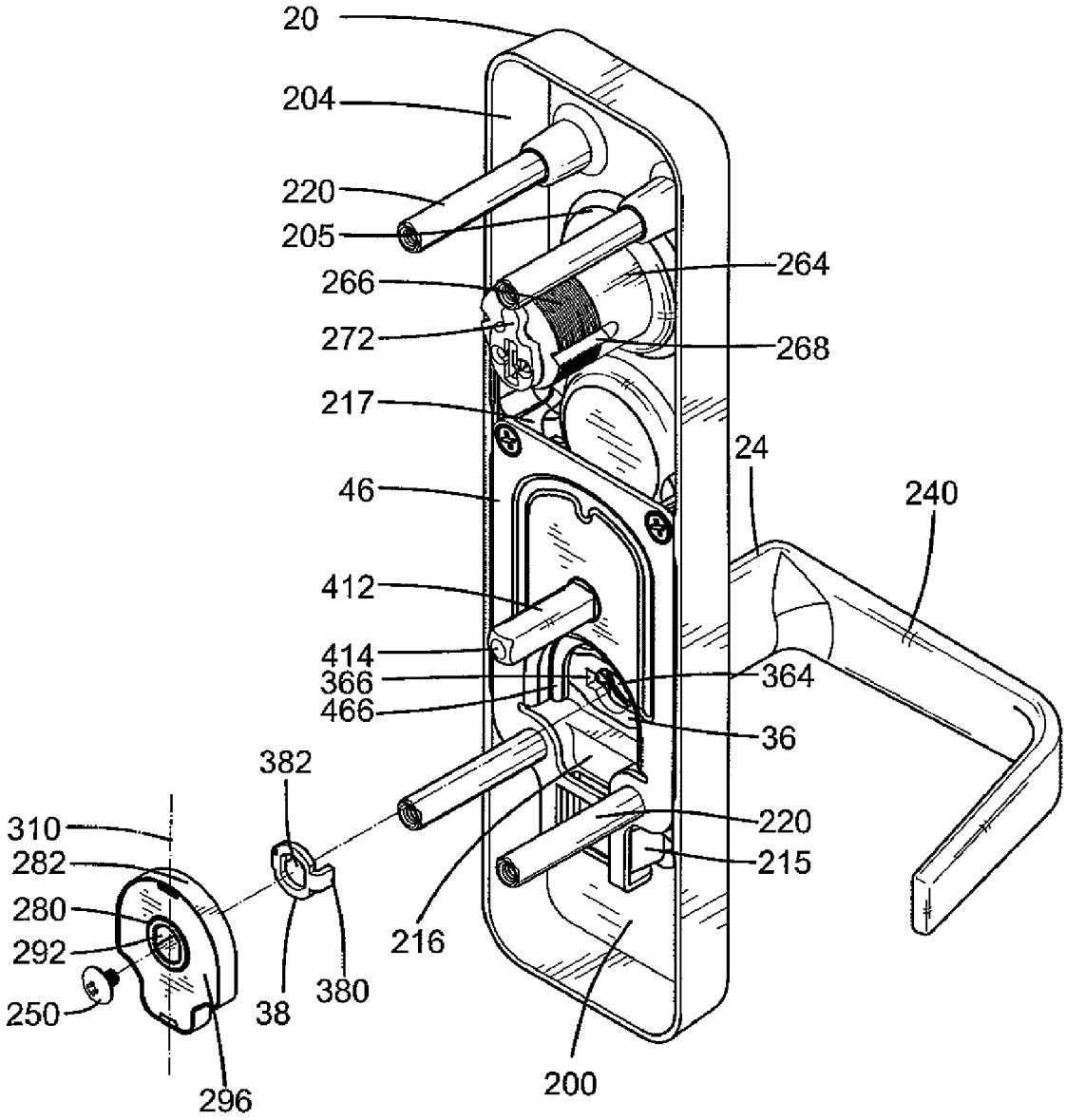
FIG. 14 is an exploded, perspective view showing mounting of the outer operational device according to the preferred teachings of the present invention to a left-handed door.
Figure 15:
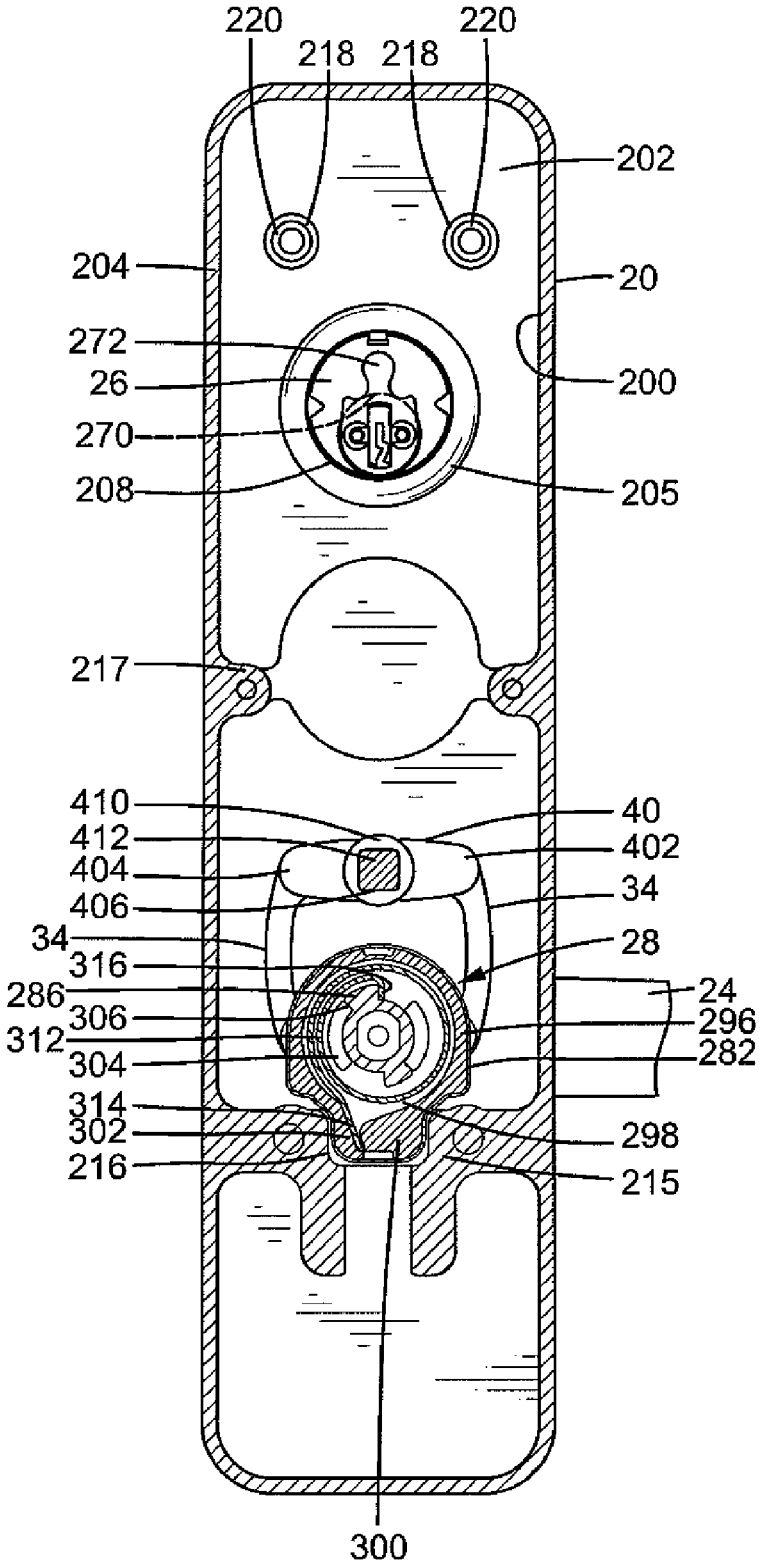
FIG. 15 shows a cross sectional view of the outer operational device of FIG. 14.

Furthermore, outer operational device 2 according to the teachings of the present invention allows easy replacement of handle 24 so that it can be mounted to either a right-handed door or a left-handed door through simple operation. Specifically, door 10 shown in FIG. 1 is a right-handed door, and handle 24 is rotated counterclockwise for unlocking purposes. With reference to FIG. 14, when it is desired to mount outer operational device 2 according to the teachings of the present invention on a left-handed door, fastener 250 is firstly removed. Returning device 28 and follower 38 are then removed from engaging portion 244 of handle 24. Handle 24 is rotated 180° (FIG. 15). Note that other elements are not actuated, for actuating member 36 rotates freely on handle 24. After mounting follower 38 on engaging portion 244 of handle 24, returning device 28 is rotated 180° about an axis 310 (FIG. 14) and then mounted back onto engaging portion 244 of handle 24, with housing 282 located behind body 296 (housing 282 is in front of body 296 when utilized with a right-handed door). Then, fastener 250 is screwed into engaging portion 244 to fix returning device 28 in place. Thus, outer operational device 2 according to the teachings of the present invention is mounted to a left-handed door. The operational procedure is simple and can be rapidly carried out on the site.

Since follower 38 acts as a medium for driving actuating member 36 when handle 24 is rotated, teeth 380 of follower 38 break when an excessive force is applied to handle 24. Thus, handle 24 rotates freely to avoid damage to outer operational device 2 according to the teachings of the present invention and other components of outer operational device 2 according to the teachings of the present invention.

Now that the basic teachings of the present invention have been explained, many extensions and variations will be obvious to one having ordinary skill in the art. For example, follower 38 can include only one tooth 380, and actuating member 36 can include only one groove 366 receiving tooth 380 of follower 38. Furthermore, actuating member 36 can include only one axle 368, and driving member 40 can include only one peg 408. In this case, only one link 34 is required.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An outer operational device for a panic exit door lock, comprising, in combination:

a cover adapted to be mounted to a side of a door, with the cover defining a space;

a handle including a shank having an engaging portion with non-circular cross sections, with the shank rotatably received in the cover;

a latch movable between an extended, locking position and a retracted, unlocking position along a latch axis;

an actuating member mounted in the space and including a first end and a connecting hole rotatably engaged on the shank, with the actuating member further including a first groove in an inner periphery of the non-circular connecting hole;

a follower including a non-circular hole engaged with the engaging portion of the handle, with the follower and the handle rotating jointly, with a first tooth protruding out of the follower and engaged in the first groove, with the first tooth having a thickness in a vertical direction perpendicular to the latch axis smaller than a thickness of the follower in the vertical direction, with the handle, the actuating member, and the follower rotating jointly about a first rotating axis spaced from the latch axis in the vertical direction, with the first tooth breakable by an excessive force applied to the handle;

a first link including an upper end and a lower end, with the lower end of the first link pivotably coupled with the first end of the actuating member; and a driving member including a pivotal portion pivotably received in the space of the cover, with a first wing extending from the pivotal portion and pivotably coupled at a first pivot axis to the upper end of the first link, with the first pivot axis being positionally fixed relative to each of the first wing and the first link, with a driving rod securely coupled with the pivotal portion, with the driving rod and the driving member rotating jointly about a second rotating axis parallel to and spaced from the first rotating axis, with the second rotating axis located between the first rotating axis and the latch axis, with a spacing between the second rotating axis and the latch axis being larger than a spacing between the second rotating axis and the first rotating axis, with the driving rod operably coupled to the latch, wherein rotation of the handle causes rotation of the follower and the actuating member about the first rotating axis to move the first link to push the first wing, causing rotational movement of the driving member, and the driving rod rotates jointly with the driving member about the second rotating axis, moving the latch between the extended, locking position and the retracted, unlocking position along the latch axis, wherein if the handle is rotated by the excessive force, the first tooth is broken and the handle rotates freely without rotating the actuating member, the first link and the driving member.

2. The outer operational device as claimed in claim 1, with the actuating member including a second groove in the inner periphery of the non-circular connecting hole, with a second tooth protruding out of the follower and engaged in the second groove, with the second tooth having a thickness in the vertical direction smaller than the thickness of the follower, with the second tooth breakable by the excessive force applied to the handle, wherein if the handle is rotated by the excessive force, the second tooth is broken and the handle rotates freely without rotating the actuating member, the first link and the driving member.

3. The outer operational device as claimed in claim 1, further comprising, in combination: a returning device mounted in the space and including:

a body including a compartment;

a housing mounted around the body and covering the compartment of the body;

a rotatable member rotatably mounted in the compartment and not extending beyond the body, with the rotatable member including a non-circular hole engaged with the engaging portion, wherein the rotatable member and the handle rotate jointly; and an elastic element mounted between the body and the rotatable member for returning the rotatable member and the handle.

4. The outer operational device as claimed in claim 3, with the body including a pivot hole in communication with the compartment, with first and second limiting blocks formed on a side of the body along a periphery of the pivot hole, with each of the first and second limiting blocks having an end, with the housing including an axial hole aligned with the pivot hole, with the rotatable member rotatably received in the axial hole and the pivot hole, with the rotatable member further including first and second blocks on an outer periphery thereof, with each of the first and second blocks located between the first and second limiting blocks, wherein one of the first and second blocks comes in contact with and is stopped by the end of one of the first and second limiting blocks when the handle is rotated, limiting further rotational movement of the handle.

5. The outer operational device as claimed in claim 4, with the rotatable member further including a flange on the outer periphery thereof, with a slit formed between the first block and an end of the flange, with the elastic element including a spiral section mounted around the first and second limiting blocks, a first tang fixed to the body, and a second tang fixed in the slit.

6. The outer operational device as claimed in claim 5, further comprising, in combination: a fastener threadedly engaged with an end face of the engaging portion and including a head abutting against the rotatable member, with the fastener preventing movement of the returning device along the first rotating axis about which the rotatable member is rotatable.

7. The outer operational device as claimed in claim 1, with the driving member further including a second wing diametrically opposed to the first wing, with the actuating member further including a second end, with the connecting hole intermediate the first and second ends of the actuating member, with the outer operational device further comprising, in combination: a second link including an upper end pivotably coupled at a second pivot axis with the second wing and a lower end pivotably coupled with the second end of the actuating member, with the second pivot axis being positionally fixed relative to each of the second wing and the second link, with the second rotating axis located intermediate the first and second pivot axes.

8. The outer operational device as claimed in claim 1, further comprising, in combination: a key-operable cylinder mounted to the cover and including a lock core rotatably mounted therein, with an actuator mounted outside of the cylinder and fixed to the lock core to rotate therewith, with the actuator movable between a first position and a second position through operation of a key, wherein with the actuator in the first position, rotation of the handle causes retraction of the latch, and wherein with the actuator in the second position, the latch is not retracted by rotation of the handle.

* * * * *